US010720107B2

(12) United States Patent
Kim et al.

(10) Patent No.: US 10,720,107 B2
(45) Date of Patent: Jul. 21, 2020

(54) DISPLAY DEVICE

(71) Applicant: Samsung Display Co., Ltd., Yongin-si, Gyeonggi-do (KR)

(72) Inventors: Dong Woo Kim, Yongin-si (KR); Bo Yong Chung, Yongin-si (KR); Yeon Kyung Kim, Yongin-si (KR); Chong Chul Chai, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/203,476

(22) Filed: Nov. 28, 2018

(65) Prior Publication Data

US 2019/0251904 A1 Aug. 15, 2019

(30) Foreign Application Priority Data

Feb. 12, 2018 (KR) ..... 10-2018-0016977

(51) Int. Cl.

| | |
|---|---|
| ***G09G 3/3258*** | (2016.01) |
| ***G09G 3/3283*** | (2016.01) |
| ***G09G 3/3233*** | (2016.01) |
| *G09G 3/3241* | (2016.01) |

(52) U.S. Cl.

CPC ..... *G09G 3/3258* (2013.01); *G09G 3/3233* (2013.01); *G09G 3/3283* (2013.01); *G09G 3/3241* (2013.01); *G09G 2300/0819* (2013.01); *G09G 2300/0852* (2013.01);

(Continued)

(58) Field of Classification Search

CPC .. G09G 3/3258; G09G 3/3241; G09G 3/3283; G09G 2300/0861; G09G 2310/061; G09G 3/3233; G09G 2310/08; G09G 2320/045; G09G 2300/0852;

(Continued)

(56) References Cited

U.S. PATENT DOCUMENTS

| | | | |
|---|---|---|---|
| 9,355,593 | B2 | 5/2016 | Jeong et al. |
| 9,514,677 | B2 | 12/2016 | Chung et al. |
| 9,524,667 | B2 | 12/2016 | In et al. |

(Continued)

FOREIGN PATENT DOCUMENTS

| | | | |
|---|---|---|---|
| KR | 10-2013-0098613 | A | 9/2013 |
| KR | 10-2014-0111502 | A | 9/2014 |

(Continued)

*Primary Examiner* — Julie Anne Watko

(74) *Attorney, Agent, or Firm* — Lewis Loca Rothgerber Christie LLP

(57) ABSTRACT

A display device having a frame period including reset, compensation, relay, emission, and initialization periods. Each pixel includes: an organic light emitting diode having an anode coupled to a second node and a electrode coupled to a second power source; a first transistor between a first power source and the second node, and a gate electrode coupled to a first node; a second transistor between the first node and the second node; a third transistor between the first power source and a third node; a fourth transistor between a fourth node and the third node; a fifth transistor between a data line and the fourth node; a sixth transistor between a third power source and the second node; a first capacitor between the third node and the first node; and a second capacitor coupled the fourth node and the third power source.

20 Claims, 8 Drawing Sheets

(52) U.S. Cl.
CPC ..... *G09G 2300/0861* (2013.01); *G09G 2310/061* (2013.01); *G09G 2310/08* (2013.01); *G09G 2320/043* (2013.01)

(58) Field of Classification Search
CPC ..... G09G 2320/043; G09G 2320/04; G09G 2300/0819
See application file for complete search history.

(56) References Cited

U.S. PATENT DOCUMENTS

| | | | | |
|---|---|---|---|---|
| 9,779,662 | B1 | 10/2017 | Zhang et al. | |
| 10,001,873 | B2 * | 6/2018 | Kim | G09G 3/3233 |
| 2012/0306840 | A1 * | 12/2012 | Han | G09G 3/003 345/212 |
| 2014/0253612 | A1 * | 9/2014 | Hwang | G09G 3/3258 345/691 |
| 2014/0307010 | A1 * | 10/2014 | Han | G09G 3/3233 345/691 |
| 2014/0333512 | A1 * | 11/2014 | In | G09G 3/3233 345/76 |
| 2017/0294162 | A1 | 10/2017 | Hu et al. | |
| 2018/0005576 | A1 * | 1/2018 | Yoon | G09G 3/3233 |
| 2019/0318693 | A1 * | 10/2019 | Jung | G09G 3/3291 |

FOREIGN PATENT DOCUMENTS

| | | | |
|---|---|---|---|
| KR | 10-2014-0134048 | A | 11/2014 |
| KR | 10-2014-0142002 | A | 12/2014 |

* cited by examiner

DISPLAY DEVICE

CROSS-REFERENCE TO RELATED APPLICATION

This application claims priority to and the benefit of Korean patent application 10-2018-0016977 filed on Feb. 12, 2018 in the Korean Intellectual Property Office, the entire disclosure of which is incorporated herein by reference.

BACKGROUND

1. Field

An aspect of the present disclosure relates to a display device.

2. Related Art

With the development of information technologies, the importance of a display device has increased. Accordingly, display devices such as a liquid crystal display device and an organic light emitting display device are increasingly used. Today's display devices are often packaged with various sensors such as touch sensors for sensing touches, fingerprint sensors, pressure sensors, etc.

An organic light emitting display device includes organic light emitting diodes (OLEDs) each having a luminance that is controlled by a current or a voltage. Each OLED includes a positive electrode layer and a negative electrode layer, which form an electric field, and an organic light emitting material that emits light in response to the electric field.

The organic light emitting display device displays an image by allowing a plurality of pixels to emit light during an emission period in a frame.

SUMMARY

Embodiments provide a display device capable of improving image quality.

According to an aspect of the present disclosure, there is provided a display device. The display device includes pixels driven in units of frames, where each frame period includes a reset period, a compensation period, a relay period, an emission period, and an initialization period and. The initialization period is located between the reset period and the compensation period or between the relay period and the emission period. Each of the pixels includes: an organic light emitting diode having an anode electrode coupled to a second node and a cathode electrode coupled to a second power source; a first transistor coupled between a first power source and the second node, the first transistor having a gate electrode coupled to a first node; a second transistor coupled between the first node and the second node, the second transistor being turned on when a compensation signal is supplied during the compensation period; a third transistor coupled between the first power source and a third node, the third transistor being configured to turn on when a reset signal is supplied during the reset period; a fourth transistor coupled between a fourth node and the third node, the fourth transistor being configured to turn on when a relay signal is supplied during the relay period; a fifth transistor coupled between a data line and the fourth node, the fifth transistor being configured to turn on when a scan signal is supplied during the emission period; a sixth transistor coupled between a third power source and the second node, the sixth transistor being configured to turn on when an initialization signal is supplied during the initialization period; a first capacitor coupled between the third node and the first node; and a second capacitor coupled between the fourth node and the third power source, wherein the initialization period is located between the reset period and the compensation period or between the relay period and the emission period.

During the initialization period, the compensation signal may not be supplied, and when the sixth transistor is turned on as the initialization signal is supplied, initializing the anode electrode of the organic light emitting diode to the voltage of the third power source.

The initialization period may be located between the reset period and the compensation period.

The initialization period may be located between the relay period and the emission period.

The initialization period may be located between the reset period and the compensation period and between the relay period and the emission period.

During the reset period, the first power source may have a low-level voltage, and when the third transistor is turned on as the reset signal is supplied, resetting the anode electrode of the organic light emitting diode to the low-level voltage of the first power source.

During the compensation period, the first transistor may be diode-coupled when the second transistor is turned on as the compensation signal is supplied, and the first capacitor may store a threshold voltage of the first transistor when the third transistor is turned on as the reset signal is supplied.

During the relay period, when the fourth transistor is configured to turn on as the relay signal is supplied, a voltage stored in the second capacitor may be transferred to the first capacitor.

During the emission period, the voltage of the first power source may be applied to the third node when the third transistor is configured to turn on as the reset signal is supplied, the first power source may have a high-level voltage, the second power source may have a low-level voltage, and the organic light emitting diode may generate light.

During the emission period, the data line and the fourth node are electrically coupled to each other when the fifth transistor is turned on as the scan signal is supplied, and a data signal of a current frame may be applied to the fourth node in synchronization with the scan signal.

The frame period may further include an off period for applying an off bias to the first transistor. The off period may be located prior to the reset period.

During the off period, the first power source may have a low-level voltage, and the compensation signal may be supplied.

The display device may further include: a display unit including the pixels; a driving signal supply configured to supply the reset signal, the compensation signal, the relay signal, and the initialization signal to the display unit; and a power supply configured to determine a voltage of each of the first power source, the second power source, and the third power source, and supply the determined voltages to the display unit.

The display device may further include: a scan driver configured to sequentially supply scan signals to scan lines; and a data driver configured to supply data signals to data lines.

The first to sixth transistors may be P-channel MOS transistors.

According to an aspect of the present disclosure, there is provided a display device. The display device includes pixels driven in units of frame periods. Each frame period includes a reset period, a compensation period, a relay period, an emission period, and an initialization period. The initialization period is located between the relay period and the emission period. Each of the pixels includes: an organic light emitting diode having an anode electrode coupled to a second node and a cathode electrode coupled to a second power source; a first transistor coupled between a first power source and the second node, the first transistor having a gate electrode coupled to a first node; a second transistor coupled between the first node and the second node, the second transistor being configured to turn on when a compensation signal is supplied during the compensation period; a third transistor coupled between the first power source and a third node, the third transistor being configured to turn on when a reset signal is supplied during the reset period; a fourth transistor coupled between a fourth node and the third node, the fourth transistor being configured to turn on when a relay signal is supplied during the relay period and the initialization period; a fifth transistor coupled between a data line and the fourth node, the fifth transistor being configured to turn on when a scan signal is supplied during the initialization period and the emission period; a first capacitor coupled between the third node and the first node; and a second capacitor coupled between the fourth node and a third power source.

During the initialization period, the relay signal may be supplied, and scan signals may be supplied in a lump.

Data signals may have a first reference voltage during the reset period, the compensation period, and the relay period. The data signals may have a second reference voltage different from the first reference voltage during the initialization period.

The second reference voltage may be lower than the first reference voltage.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
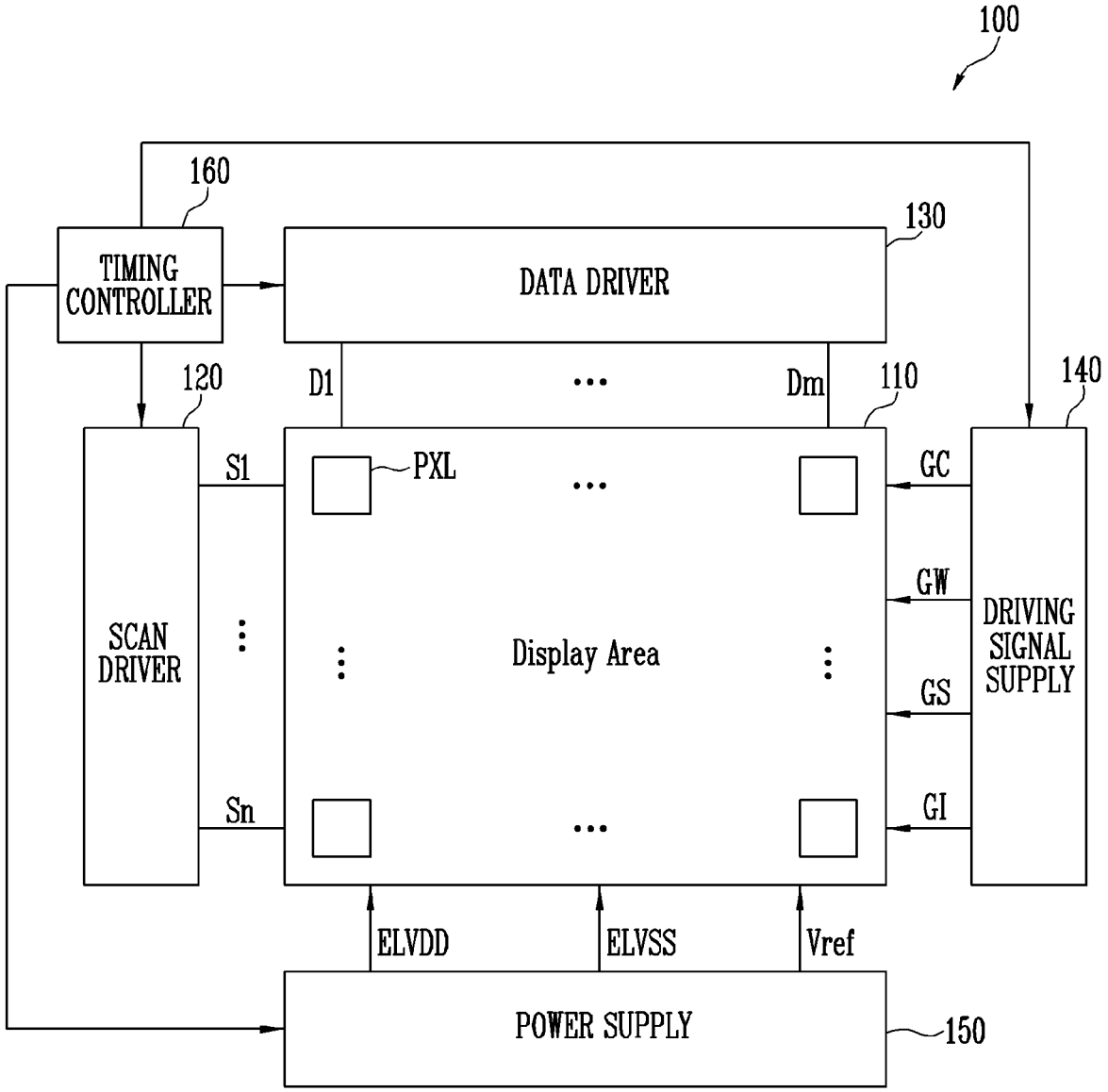
FIG. 1 is a diagram illustrating a display device according to an embodiment of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein. FIG. 1 is a diagram illustrating a display device 100 according to an embodiment of the present disclosure.

Referring to FIG. 1, the display device 100 may include a display unit 110, a scan driver 120, a data driver 130, a driving signal supply 140, a power supply 150, and a timing controller 160.

Although the scan driver 120, the data driver 130, the driving signal supply 140, the power supply 150, and the timing controller 160 are individually illustrated in FIG. 1, in some embodiments, at least some of the components may be integrated.

The scan driver 120, the data driver 130, the driving signal supply 140, the power supply 150, and the timing controller 160 may be installed in various ways including chip on glass, chip on plastic, tape carrier package, chip on film, and the like.

The display unit 110 may correspond to a display area of the display device 100. For example, the display device 100 may display an image through the display area.

The display unit 110 may receive a reset signal GS, a compensation signal GC, a relay signal GW, and an initialization signal GI from the driving signal supply 140. Also, the display unit 110 may receive a first power source ELVDD, a second power source ELVSS, and a third power source Vref from the power supply 150.

The display unit 110 may include pixels PXL.

The pixels PXL may be arranged in a matrix structure. For example, the pixels PXL may be arranged in areas in which scan lines S1 to Sn (n is a natural number) and data lines D1 to Dm (m is a natural number) cross each other. The pixels PXL may be coupled to the scan lines S1 to Sn and the data lines D1 to Dm at every crossing to form pixel rows and pixel columns.

Although n scan lines S1 to Sn are illustrated in FIG. 1, the present disclosure is not limited thereto. In some embodiments, dummy scan lines may be additionally formed so as to stably drive the display device 100.

The pixels PXL may receive scan signals through the scan lines S1 to Sn, and receive data signals through the data lines D1 to Dm. In various embodiments, each of the pixels PXL may store a voltage corresponding to a data signal supplied to a corresponding one of the pixels PXL.

In various embodiments, the pixels PXL may be coupled to driving signal lines (not shown). In various embodiments, the pixels PXL may receive the reset signal GS, the compensation signal GC, the relay signal GW, and the initialization signal GI through the driving signal lines (not shown).

The pixels PXL may be coupled to the first power source ELVDD, the second power source ELVSS, and the third power source Vref.

Each of the pixels PXL may control an amount of driving current flowing from the first power source ELVDD to the second power source ELVSS via an organic light emitting diode (not shown), based on a voltage stored in each of the pixels PXL. At this time, the organic light emitting diode may generate light with a luminance corresponding to the amount of driving current.

The pixels PXL may be driven in units of frames (e.g., on a frame-by-frame basis).

The scan driver 120 may receive a scan driving control signal from the timing controller 160. For example, the scan driving control signal may include clock signals and a scan start signal. The scan start signal may control supply timings of scan signals, and the clock signals may be used to shift the scan start signal.

The scan driver 120 may generate scan signals, based on the scan driving control signal. For example, the scan signals may have a gate-on voltage at which transistors included in the pixels PXL can be turned on.

The scan driver 120 may be coupled to the scan lines S1 to Sn.

The scan driver 120 may supply the scan signals to the scan lines S1 to Sn. For example, the scan driver 120 may sequentially supply the scan signals to the scan lines S1 to Sn. However, the present disclosure is not limited thereto, and the scan driver 120 may concurrently supply (e.g., in a lump) the scan signals to the scan lines S1 to Sn.

In this specification, that a "scan signal is supplied" may mean that the scan signal has the gate-on voltage.

In various embodiments, the data driver 130 may receive a data driving control signal and image data from the timing controller 160. For example, the data driving control signal may include a source start signal, a source output enable signal, a source sampling clock, and the like. The source start signal may control a data sampling start time of the data driver 130. The source sampling clock may control a sampling operation of the data driver 130, based on a rising or falling edge of the source sampling clock. The source output enable signal may control an output timing of the data driver 130.

The data driver 130 may generate data signals, based on the data driving control signal and the image data. For example, the data signals may have a voltage corresponding to the image data. In various embodiments, the data signals may have a voltage in a range (e.g., a predetermined range).

The data driver 130 may be coupled to the data lines D1 to Dm.

The data driver 130 may supply the data signals to the data lines D1 to Dm. For example, the data driver 130 may supply the data signals to the data lines D1 to Dm in syncrhonization with the sequentially supplied scan signals.

In this specification, that a "data signal is supplied" may mean that the data signal has a voltage in a range (e.g., a predetermined range), which corresponds to image data.

In various embodiments, the driving signal supply 140 may receive a driving signal supply control signal from the timing controller 160.

In various embodiments, the driving signal supply 140 may supply the reset signal GS, the compensation signal GC, the relay signal GW, and the initialization signal GI to the display unit 110, based on the driving signal supply control signal.

In various embodiments, the same reset signal GS, the same compensation signal GC, the same relay signal GW, and the same initialization signal GI may be supplied to all of the pixels PXL. Therefore, a reset operation, a compensation operation, an initialization operation, and a relay operation of the display device 100, which will be described later, may be concurrently (e.g., substantially simultaneously) performed on all of the pixels PXL.

In this specification, that the "reset signal GS", the "compensation signal GC", the "relay signal GW", and the "initialization signal GI" are supplied may mean that the reset signal GS, the compensation signal GC, the relay signal GW, and the initialization signal GI respectively, have the gate-on voltage.

In some embodiments, the power supply 150 may receive a power supply control signal from the timing controller 160.

The power supply 150 may supply the first power source ELVDD, the second power supply ELVSS, and the third power source Vref to the display unit 110, based on the power supply control signal.

The power supply 150 may determine a voltage of each of the first power source ELVDD, the second power supply ELVSS, and the third power source Vref.

During an emission period in which the pixels PXL emit light (e.g., predetermined light), the first power source ELVDD and the second power source ELVSS may have a voltage capable of generating a driving current in the pixels PXL.

In some embodiments, the first power source ELVDD may have a voltage higher than that of the second power source ELVSS.

Each of the first power source ELVDD and the second power source ELVSS may have any one of a high-level voltage and a low-level voltage.

The third power source Vref may have a preset voltage. For example, the third power source Vref may have a voltage of 0 V.

However, the present disclosure is not limited thereto, and each of the first power source ELVDD, the second power source ELVSS, and the third power source Vref may have a voltage in a range (e.g., in a predetermined range).

In some embodiments, the timing controller 160 may receive image data and timing signals (e.g., a vertical synchronization signal, a horizontal synchronization signal, a data enable signal, a clock signal, and the like) from a host system (not shown).

The timing controller 160 may control the components (e.g., the display unit 110, the scan driver 120, the data driver 130, the driving signal supply 140, and the power supply 150) of the display device 100, based on the image data and the timing signals.

For example, the timing controller 160 may transmit the scan driving control signal to the scan driver 120, transmit the data driving control signal to the data driver 130, transmit the driving signal supply control signal to the driving signal supply 140, and transmit the power supply control signal to the power supply 150.

Figure 2:
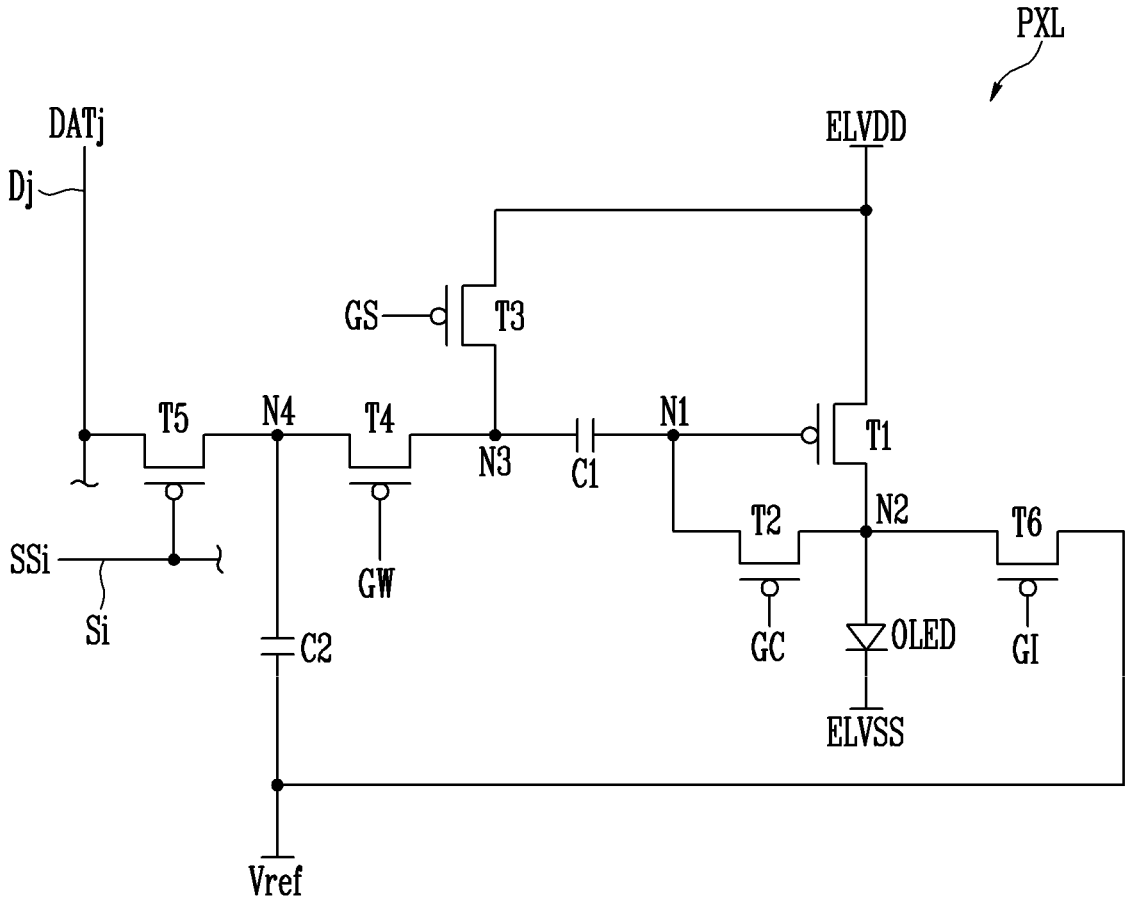
FIG. 2 is a diagram illustrating a pixel according to an embodiment of the present disclosure.

FIG. 2 is a diagram illustrating a pixel PXL according to an embodiment of the present disclosure.

For convenience of description, a pixel PXL coupled to an ith scan line Si and a jth data line Dj among the pixels PXL shown in FIG. 1 is representatively illustrated in FIG. 2.

Referring to FIG. 2, the pixel PXL may include an organic light emitting diode OLED, a first transistor T1, a second transistor T2, a third transistor T3, a fourth transistor T4, a fifth transistor T5, a sixth transistor T6, a first capacitor C1, and a second capacitor C2.

An anode electrode of the organic light emitting diode OLED may be coupled to a second node N2, and a cathode electrode of the organic light emitting diode OLED may be coupled to a second power source ELVSS.

Here, the second node N2 refers to a node commonly coupled to the anode electrode of the organic light emitting diode OLED, the first transistor T1, the second transistor T2, and the sixth transistor T6.

The organic light emitting diode OLED may generate light with a luminance (e.g., a predetermined luminance) corresponding to a driving current.

A first power source ELVDD may be set to a voltage higher than that of the second power source ELVSS such that a current flows through the organic light emitting diode OLED during an emission period.

The organic light emitting diode OLED may include an emitting layer that emits light of one of primary colors. For example, the primary colors may include red, green, and blue.

The first transistor (driving transistor) T1 may be coupled between the first power source ELVDD and the second node N2. In addition, a gate electrode of the first transistor T1 may be coupled to a first node N1.

In some embodiments, the first node N1 refers to a node commonly coupled to the gate electrode of the first transistor T1, the second transistor T2, and the first capacitor C1.

The first transistor T1 may control an amount of driving current flowing from the first power source ELVDD to the second power source ELVSS via the organic light emitting diode OLED (e.g., the current corresponding to a voltage of the first node N1).

The second transistor (compensation transistor) T2 may be coupled between the second node N2 and the first node N1. When a compensation signal GC is supplied, the second transistor T2 may be turned on.

In some embodiments, when the second transistor T2 is turned on, the first node N1 and the second node N2 may be electrically coupled to each other. Therefore, the first transistor T1 may be diode-coupled when the second transistor T2 is turned on.

The third transistor (reset transistor) T3 may be coupled between the first power source ELVDD and a third node N3. When a reset signal GS is supplied, the third transistor T3 may be turned on.

The third node N3 refers to a node commonly coupled to the third transistor T3, the fourth transistor T4, and the first capacitor.

In some embodiments, when the third transistor T3 is turned on, the first power source ELVDD and the third node N3 may be electrically coupled to each other. Therefore, the voltage of the first power source ELVDD may be applied to the third node N3.

The fourth transistor (relay transistor) T4 may be coupled between a fourth node N4 and the third node N3. When a relay signal GW is supplied, the fourth transistor T4 may be turned on.

In some embodiments, the fourth node N4 refers to a node commonly coupled to the fourth transistor T4, the fifth transistor T5, and the second capacitor C2.

In some embodiments, when the fourth transistor T4 is turned on, the fourth node N4 and the third node N3 may be electrically coupled to each other. Therefore, a voltage stored in the second capacitor C2 may be transferred to the first capacitor C1.

The fifth transistor (switching transistor) T5 may be coupled between the jth data line Dj and the fourth node N4. When an ith scan signal SSi is supplied to the ith scan line Si, the fifth transistor T5 may be turned on.

In various embodiments, when the fifth transistor T5 is turned on, the jth data line Dj and the fourth node N4 may be electrically coupled to each other. Therefore, a voltage corresponding a data signal DATj supplied to the jth data line Dj may be applied to the fourth node N4 and be stored in the second capacitor C2.

The sixth transistor (initialization transistor) T6 may be coupled between a third power source Vref and the second node N2. When an initialization signal GI is supplied, the sixth transistor T6 may be turned on.

In some embodiments, when the sixth transistor T6 is turned on, the third power source Vref and the second node N2 may be electrically coupled to each other. Therefore, the anode electrode of the organic light emitting diode OLED may be initialized to the voltage of the third power source Vref.

The first capacitor C1 may be coupled between the third node N3 and the first node N1.

The second capacitor C2 may be coupled between the fourth node N4 and the third power source Vref.

In some embodiments, at least one of the first transistor T1, the second transistor T2, the third transistor T3, the fourth transistor T4, the fifth transistor T5, and the sixth transistor T6 may be implemented with a P-channel metal oxide semiconductor (MOS) transistor. The gate-on voltage of the P-channel MOS transistor may be a low-level voltage.

However, the present disclosure is not limited thereto. In some embodiments, at least one of the first transistor T1, the second transistor T2, the third transistor T3, the fourth transistor T4, the fifth transistor T5, and the sixth transistor T6 may be implemented with an N-channel MOS transistor. The gate-on voltage of the N-channel MOS transistor may be a high-level voltage.

Figure 3:
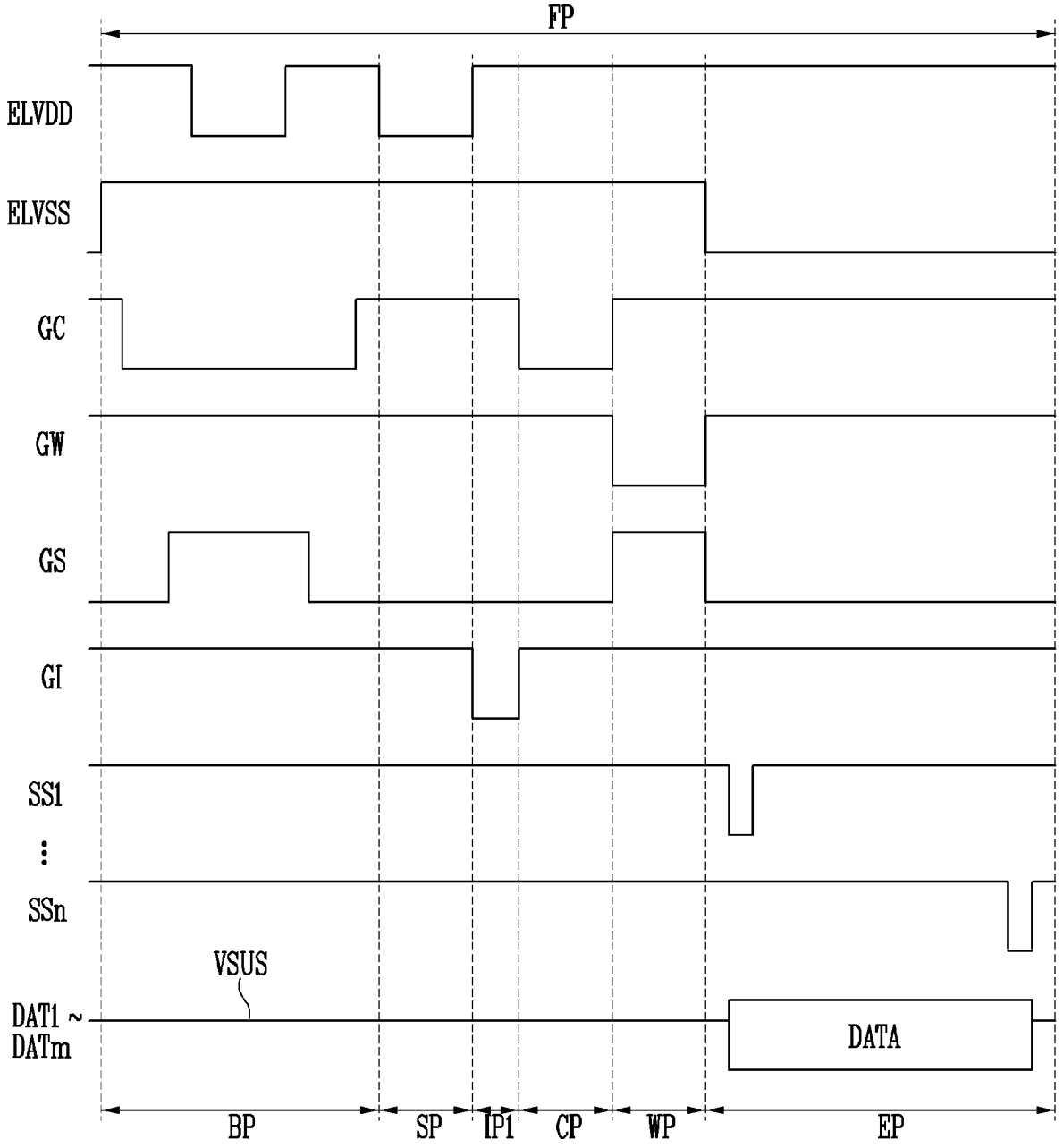
FIG. 3 is a timing diagram illustrating an embodiment of a driving method of the display device including the pixel shown in FIG. 2.

FIG. 3 is a timing diagram illustrating an embodiment of a driving method of the display device 100 including the pixel PXL shown in FIG. 2.

Referring to FIGS. 1, 2, and 3, the display device 100 may display an image during a frame period FP. The pixels PXL included in the display device 100 may be driven in units of frames (e.g., frame by frame).

Voltages of the a first power source ELVDD, a second power source ELVSS, a reset signal GS, a compensation signal GC, a relay signal GW, an initialization signal GI, first to nth scan signals SS1 to SSn, and data signals DAT1 to DATm during the frame period FP are illustrated in FIG. 3.

Hereinafter, it is described that the reset signal GS, the compensation signal GC, the relay signal GW, and the initialization signal GI have a gate-on voltage.

In FIGS. 2 and 3, an embodiment in which the first transistor T1, the second transistor T2, the third transistor T3, the fourth transistor T4, the fifth transistor T5, and the sixth transistor T6 are implemented with P-channel MOS transistors is representatively described. Therefore, the gate-on voltage is illustrated as a low-level voltage, and a gate-off voltage is illustrated as a high-level voltage.

According to the embodiment of the driving method of the display device 100, which is shown in FIG. 3, the frame period FP may include an off period BP, a reset period SP, a compensation initialization period IP1, a compensation period CP, a relay period WP, and an emission period EP.

The off period BP, the reset period SP, the compensation initialization period IP1, the compensation period CP, the relay period WP, and the emission period EP may occur sequentially.

In some embodiments, the data signals DAT1 to DATm may have a first reference voltage VSUS during the other periods except the emission period EP in the frame period FP. Here, the first reference voltage VSUS may be set as a specific voltage in a voltage range of a data signal to be supplied from the data driver 130.

The second power source ELVSS may have a high-level voltage during the other periods except the emission period EP in the frame period FP. At this time, the pixels PXL are set to a non-emission state.

The off period BP is a period for applying an off bias to the first transistor T1.

The compensation signal GC may be supplied during the off period BP. If the compensation signal GC is supplied, the second transistor T2 is turned on, and therefore, the first transistor T1 may be diode-coupled.

In addition, during the off period BP, while the compensation signal GC is being supplied, the supply of the reset signal GS may be stopped. If the supply of the reset signal GS is stopped, the third transistor T3 is turned off, and therefore, the first power source ELVDD and the third node N3 may not be electrically coupled to each other.

In addition, while the supply of the reset signal GS is stopped, the first power source ELVDD may have a low-level voltage. Therefore, the low-level voltage of the first power source ELVDD may be applied to a first electrode of the first transistor T1.

At this time, because a voltage of the gate electrode of the first transistor T1 is higher than that of the first electrode of the first transistor T1, the off bias may be applied to the first transistor T1 according to transistor characteristics. Thus, a driving current can be cut off regardless of a data signal in a previous frame.

Furthermore, during the off period BP, the second power source ELVSS may have the high-level voltage, and the relay signal GW, the initialization signal GI, and the first to nth scan signals SS1 to SSn may not be supplied (e.g., each may have a high-level voltage).

In some embodiments, the off period BP may be omitted.

In some embodiments, the reset period SP is a period for resetting the anode electrode of the organic light emitting diode OLED.

In some embodiments, the reset signal GS may be supplied during the reset period SP. If the reset signal GS is supplied, the third transistor T3 is turned on, and therefore, the voltage of the first power source ELVDD may be applied to the third node N3. In addition, the first power source ELVDD may have a low-level voltage during the reset period SP. Therefore, the low-level voltage of the first power source ELVDD may be applied to the third node N3.

In some embodiments, when the low-level voltage is applied to the third node N3, the voltage of the first node N1 may be decreased due to coupling caused by the first capacitor C1. At this time, the first transistor T1 is turned on, and the anode electrode of the organic light emitting diode OLED and the first power source ELVDD may be electrically coupled to each other. Therefore, the anode electrode of the organic light emitting diode OLED may be reset to the low-level voltage of the first power source ELVDD.

In this case, a threshold voltage component of the first transistor T1, i.e., noise, may remain in the anode electrode of the organic light emitting diode OLED. The threshold voltage component may cause a spot in the display device 100, and deteriorate the threshold voltage compensation performance of the display device 100.

In some embodiments, during the reset period SP, the second power source ELVSS may have the high-level voltage, and the compensation signal GC, the relay signal GW, the initialization signal GI, and the first to nth scan signals SS1 to SSn may not be supplied (e.g., each may have a high-level voltage).

The compensation initialization period IP1 is a period for removing a threshold voltage component of the first transistor T1, i.e., noise that remains in the anode electrode of the organic light emitting diode OLED before the compensation period CP.

The initialization signal GI may be supplied during the compensation initialization period IP1. When the initialization signal GI is supplied, the sixth transistor T6 is turned on, and therefore, the second node N2 and the third power source Vref may be electrically coupled to each other. Thus, the anode electrode of the organic light emitting diode OLED may be initialized to the voltage of the third power source Vref and the threshold voltage component of the first transistor T1 may be removed from the anode electrode of the organic light emitting diode OLED.

In addition, the reset signal GS may be supplied during the compensation initialization period IP1. If the reset signal GS is supplied, the third transistor T3 is turned on, and therefore, the voltage of the first power source ELVDD may be applied to the third node N3. In some embodiments, the reset signal GS may not be supplied during the compensation initialization period IP1 (e.g., may have a high-level voltage).

Furthermore, during the compensation initialization period IP1, the first power source ELVDD and the second power source ELVSS may have the high-level voltage, and the compensation signal GC, the relay signal GW, and the first to nth scan signals SS1 to SSn may not be supplied (e.g., each may have a high-level voltage).

In some embodiments, the compensation period CP is a period for compensating for a threshold voltage of the first transistor T1.

The compensation signal GC may be supplied during the compensation period CP. If the compensation signal GC is supplied, the second transistor T2 is turned on, and therefore, the first transistor T1 may be diode-coupled.

In addition, the reset signal GS may be supplied during the compensation period CP. When the reset signal GS is supplied, the third transistor T3 is turned on, and therefore, the voltage of the first power source ELVDD may be applied to the third node N3. During the compensation period CP, a voltage obtained by subtracting the threshold voltage of the first transistor T1 from the voltage of the first power source ELVDD is applied to the first node N1. Therefore, the first capacitor C1 may store the threshold voltage of the first transistor T1. As described above, the threshold voltage of the first transistor T1 can be compensated.

Furthermore, during the compensation period CP, the first power source ELVDD and the second power source ELVSS may have the high-level voltage, and the relay signal GW, the initialization signal GI, and the first to nth scan signals SS1 to SSn may not be supplied (e.g., each may have a high-level voltage).

The relay period WP is a period for transferring the voltage of a data signal stored in the second capacitor C2 to the first capacitor C1 during the previous frame.

The relay signal GW may be supplied during the relay period WP. When the relay signal GW is supplied, the fourth transistor T4 is turned on, and therefore, the fourth node N4 and the third node N3 may be electrically coupled to each other. During the relay period WP, the voltage stored in the second capacitor C2 may be transferred to the first capacitor C1.

Furthermore, during the relay period WP, the first power source ELVDD and the second power source ELVSS may have the high-level voltage, and the compensation signal GC, the reset signal GS, the initialization signal GI, and the first to nth scan signals SS1 to SSn may not be supplied (e.g., each may have a high-level voltage).

The emission period EP is a period in which the pixels PXL emit light, and a voltage corresponding to the data signal of the current frame is stored in the second capacitor C2.

The reset signal GS may be supplied during the emission period EP. When the reset signal GS is supplied, the third transistor T3 is turned on, and therefore, the voltage of the first power source ELVDD may be applied to the third node N3.

During the emission period EP, the first to nth scan signals SS1 to SSn may be sequentially supplied, and the data signals DAT1 to DATm of the current frame may be supplied in synchronization with the first to nth scan signals SS1 to SSn that are sequentially supplied. When a scan signal is supplied, the fifth transistor T5 is turned on, and therefore, the jth data line D1 and the fourth node N4 may be electrically coupled to each other. During the emission period EP, when the scan signal is supplied, a voltage corresponding to the data signal of the current frame may be applied to the fourth node N4 and be stored in the second capacitor C2.

In addition, during the emission period EP, the first power source ELVDD may have the high-level voltage, and the second power source ELVSS may have the low-level voltage. At this time, the driving current may flow via the organic light emitting diode OLED, and the organic light emitting diode OLED may generate light according to the data signal. Thus, the pixel PXL can emit light.

In some embodiments, the voltage of the first power source ELVDD may be increased by a preset value. In this case, a difference in potential applied to the organic light emitting diode OLED is increased, and thus the image quality of the display device 100 can be improved.

During the emission period EP, the compensation signal GC, the relay signal GW, and the initialization signal GI may not be supplied during the emission period EP (e.g., each may have a high-level voltage).

Figure 4:
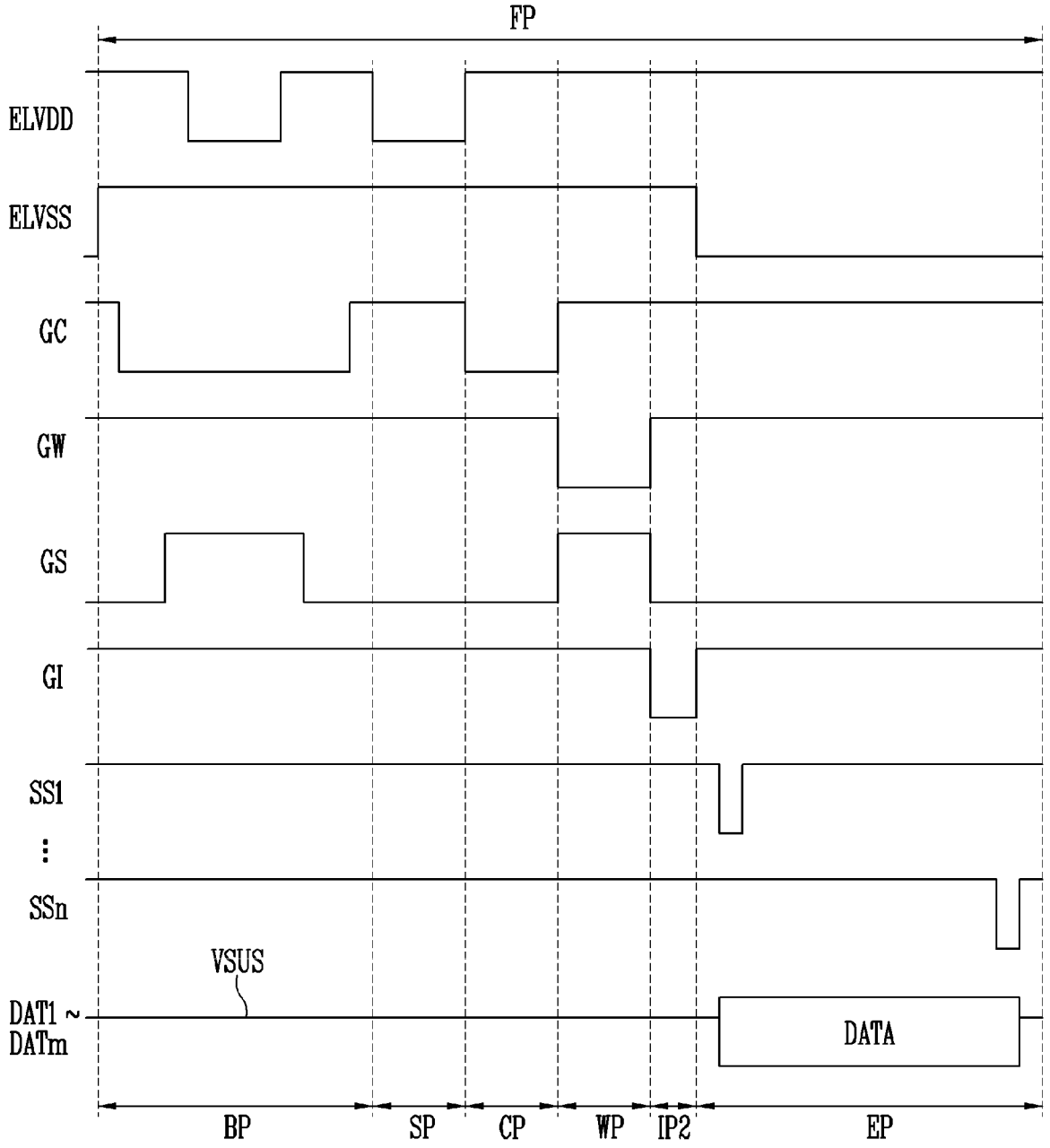
FIG. 4 is a timing diagram illustrating an embodiment of the driving method of the display device including the pixel shown in FIG. 2.

FIG. 4 is a timing diagram illustrating an embodiment of the driving method of the display device 100 including the pixel PXL shown in FIG. 2.

In FIG. 4, portions different from those of the driving method of the display device 100, which is shown in FIG. 3, will be mainly described to avoid redundancy.

Referring to FIGS. 1, 2, and 4, the display device 100 may display an image during a frame period FP. The pixels PXL included in the display device 100 may be driven in units of frames.

According to the embodiment of the driving method of the display device 100 shown in FIG. 4, the frame period FP may include an off period BP, a reset period SP, a compensation period CP, a relay period WP, an emission initialization period IP2, and an emission period EP.

The off period BP, the reset period SP, the compensation period CP, the relay period WP, the emission initialization period IP2, and the emission period EP may occur sequentially.

That is, unlike the frame period FP shown in FIG. 3, in the frame period FP shown in FIG. 4, the compensation initialization period IP1 may be omitted, and the emission initialization period IP2 may be added.

The contents of the off period BP, the reset period SP, the compensation period CP, the relay period WP, and the emission period EP, which are described in FIG. 3, may be applied to the off period BP, the reset period SP, the compensation period CP, the relay period WP, and the emission period EP, which are shown in FIG. 4.

Referring to FIG. 4, the compensation period CP may occur immediately after the reset period SP.

The emission initialization period IP2 is a period for removing a threshold voltage component of the first transistor T1, i.e., noise that remains in the anode electrode of the organic light emitting diode OLED before the emission period EP.

The initialization signal GI may be supplied during the emission initialization period IP2. When the initialization signal GI is supplied, the sixth transistor T6 is turned on, and therefore, the second node N2 and the third power source Vref may be electrically coupled to each other. During the emission initialization period IP2, the anode electrode of the organic light emitting diode OLED may be initialized to the voltage of the third power source Vref.

Initializing the anode electrode of the organic light emitting diode OLED to Vref may remove the threshold voltage component of the first transistor T1.

In addition, the reset signal GS may be supplied during the emission initialization period IP2. When the reset signal GS is supplied, the third transistor T3 is turned on, and therefore, the voltage of the first power source ELVDD may be applied to the third node N3. In some embodiments, the reset signal GS may not be supplied during the emission initialization period IP2.

Furthermore, during the emission initialization period IP2, the first power source ELVDD and the second power source ELVSS may have the high-level voltage, and the compensation signal GC, the relay signal GW, and the first to nth scan signals SS1 to SSn may not be supplied (e.g., they may each have a high-level voltage).

Figure 5:
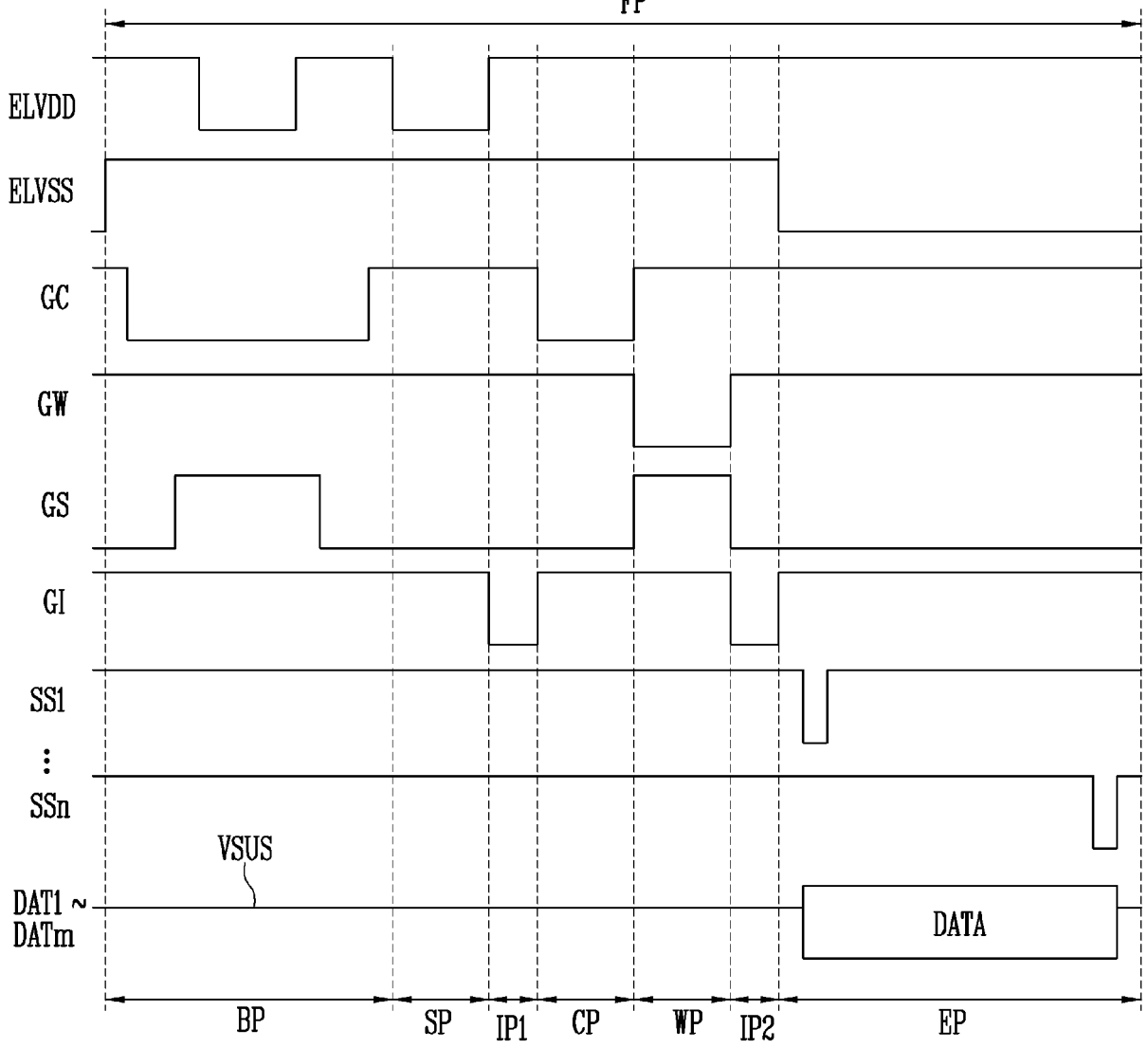
FIG. 5 is a timing diagram illustrating still an embodiment of the driving method of the display device including the pixel shown in FIG. 2.

FIG. 5 is a timing diagram illustrating still an embodiment of the driving method of the display device 100 including the pixel PXL shown in FIG. 2.

In FIG. 5, portions different from those of the driving method of the display device 100, which is shown in FIG. 3, and the driving method of the display device 100, which is shown in FIG. 4, will be mainly described to avoid redundancy.

Referring to FIGS. 1, 2, and 5, the display device 100 may display an image during a frame period FP. The pixels PXL included in the display device 100 may be driven in units of frames.

According to the embodiment of the driving method of the display device 100 shown in FIG. 5, the frame period FP may include an off period BP, a reset period SP, a compensation initialization period IP1, a compensation period CP, a relay period WP, an emission initialization period IP2, and an emission period EP.

The off period BP, the reset period SP, the compensation initialization period IP1, the compensation period CP, the relay period WP, the emission initialization period IP2, and the emission period EP may occur sequentially.

That is, unlike the frame period FP shown in FIG. 3, in the frame period FP shown in FIG. 5, the emission initialization period IP2 may be additionally included.

The contents of the off period BP, the reset period SP, the compensation initialization period IP1, the compensation period CP, the relay period WP, and the emission period EP, which are described in FIG. 3, may be applied to the off period BP, the reset period SP, the compensation initialization period IP1, the compensation period CP, the relay period WP, and the emission period EP, which are shown in FIG. 5.

In addition the content of the emission initialization period IP2, which is described in FIG. 4, may be applied to the emission initialization period IP2 shown in FIG. 5.

Figure 6:
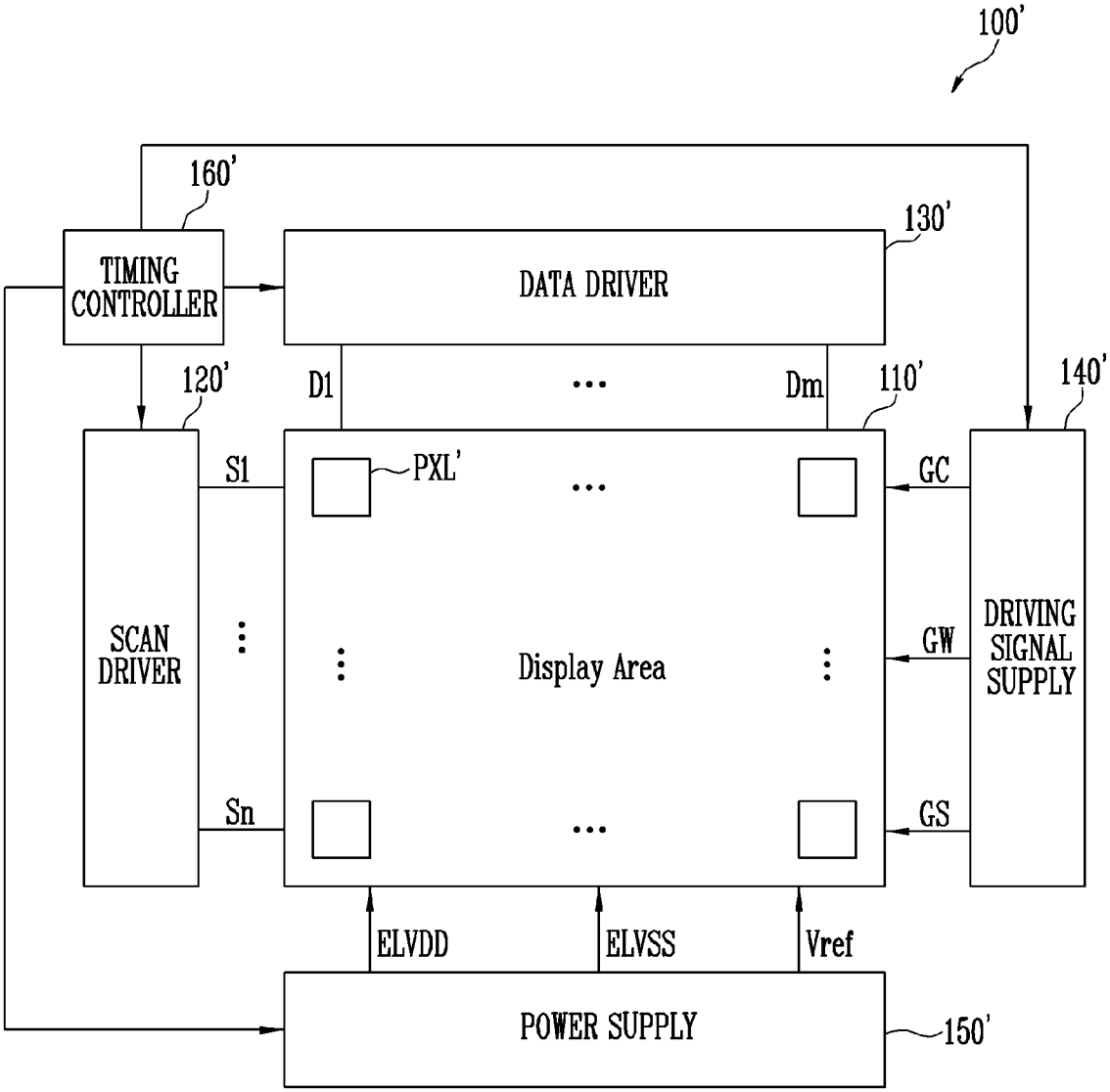
FIG. 6 is a diagram illustrating a display device according to an embodiment of the present disclosure.

FIG. 6 is a diagram illustrating a display device 100' according to an embodiment of the present disclosure.

The display device 100' shown in FIG. 6 corresponds to the display device 100 shown in FIG. 1. Therefore, differences between the display device 100' shown in FIG. 6 and the display device 100 shown in FIG. 1 will be mainly described below to avoid redundancy.

Referring to FIGS. 1 and 6, the display device 100' may include a display unit 110', a scan driver 120', a data driver 130', a driving signal supply 140', a power supply 150', and a timing controller 160'.

Although the scan driver 120', the data driver 130', the driving signal supply 140', the power supply 150', and the timing controller 160' are individually illustrated in FIG. 6, at least some of the components may be integrated, if necessary.

The display unit 110' may receive a reset signal GS, a compensation signal GC, and a relay signal GW from the driving signal supply 140'.

The display unit 110' may include pixels PXL'.

The pixels PXL' may be coupled to a driving signal lines (not shown). The pixels PXL' may receive the reset signal GS, the compensation signal GC, and the relay signal GW through the driving signal lines (not shown).

The scan driver 120' may supply scan signals to scan lines S1 to Sn. For example, the scan driver 120' may supply, sequentially or in a lump (e.g., at substantially the same time), the scan signals to the scan lines S1 to Sn.

The data driver 130' may supply data signals to data lines D1 to Dm. For example, the data driver 130' may supply the data signals to the data lines D1 to Dm to be synchronized with the scan signals supplied sequentially or in a lump (e.g., at substantially the same time).

The driving signal supply 140' may supply the reset signal GS, the compensation signal GC, and the relay signal GW to the display unit 110', based on a driving signal supply control signal.

That is, the same reset signal GS, the same compensation signal GC, and the same relay signal GW may be supplied to all of the pixels PXL'. Therefore, a reset operation, a compensation operation, an initialization operation, and a relay operation of the display device 100', which will be described later, may be concurrently (e.g., substantially simultaneously) performed on all of the pixels PXL'.

The power supply 150' may supply a first power source ELVDD, a second power source ELVSS, and a third power source Vref to the display unit 110', based on a power supply control signal.

The timing controller 160' may control the components (e.g., the display unit 110', the scan driver 120', the data driver 130', the driving signal supply 140', and the power supply 150') of the display device 100', based on image data and timing signals.

Figure 7:
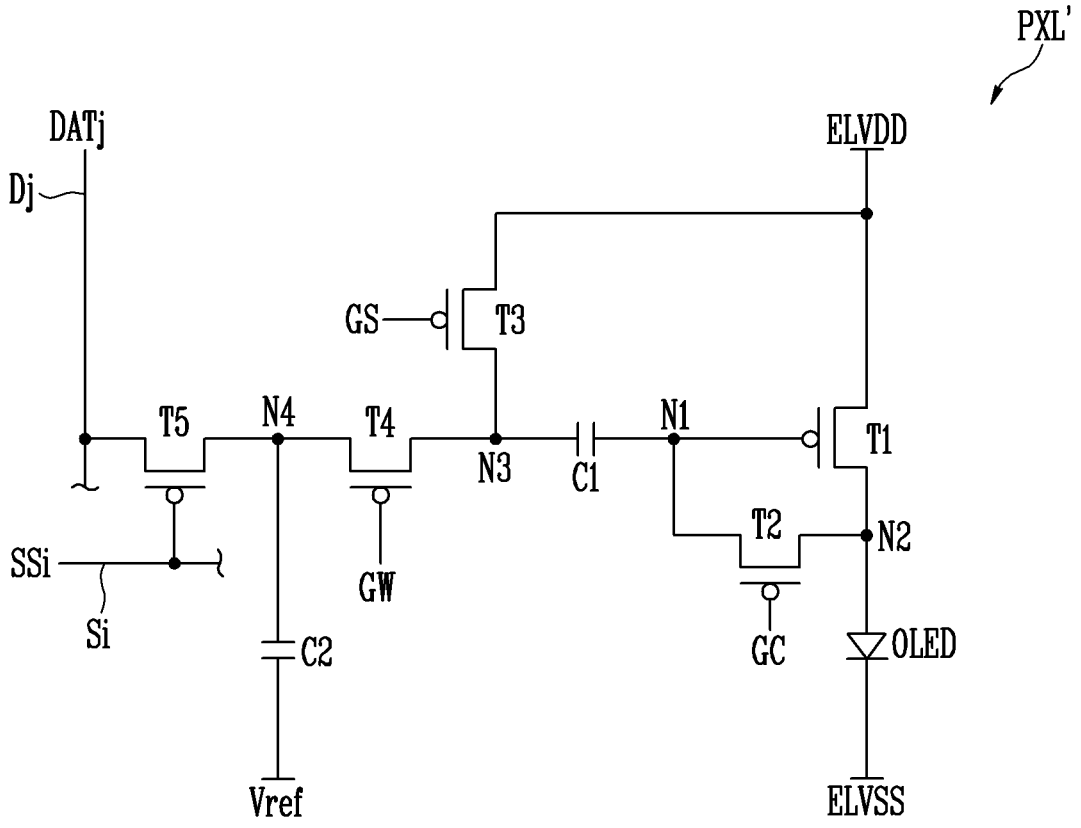
FIG. 7 is a diagram illustrating a pixel according to an embodiment of the present disclosure.

FIG. 7 is a diagram illustrating a pixel PXL' according to an embodiment of the present disclosure.

The pixel PXL' shown in FIG. 7 corresponds to the pixel PXL shown in FIG. 2. Therefore, differences between the pixel PXL' shown in FIG. 7 and the pixel PXL shown in FIG. 2 will be mainly described below to avoid redundancy.

For convenience of description, a pixel PXL' coupled to an ith scan line Si and a jth data line Dj among the pixels PXL' shown in FIG. 6 is representatively illustrated in FIG. 7.

Referring to FIGS. 2 and 7, the pixel PXL' may include an organic light emitting diode OLED, a first transistor T1, a second transistor T2, a third transistor T3, a fourth transistor T4, a fifth transistor T5, a first capacitor C1, and a second capacitor C2.

That is, unlike the pixel PXL shown in FIG. 2, the pixel PXL' shown in FIG. 7 may not include the sixth transistor T6. Therefore, a second node N2 shown in FIG. 7 refers to a node commonly coupled to an anode electrode of the organic light emitting diode OLED, the first transistor T1, and the second transistor T2.

The operation of the organic light emitting diode OLED, the first transistor T1, the second transistor T2, the third transistor T3, the fourth transistor T4, the fifth transistor T5, the first capacitor C1, and the second capacitor C2, which are described in FIG. 2, may be applied to the pixel PXL' shown in FIG. 7.

Figure 8:
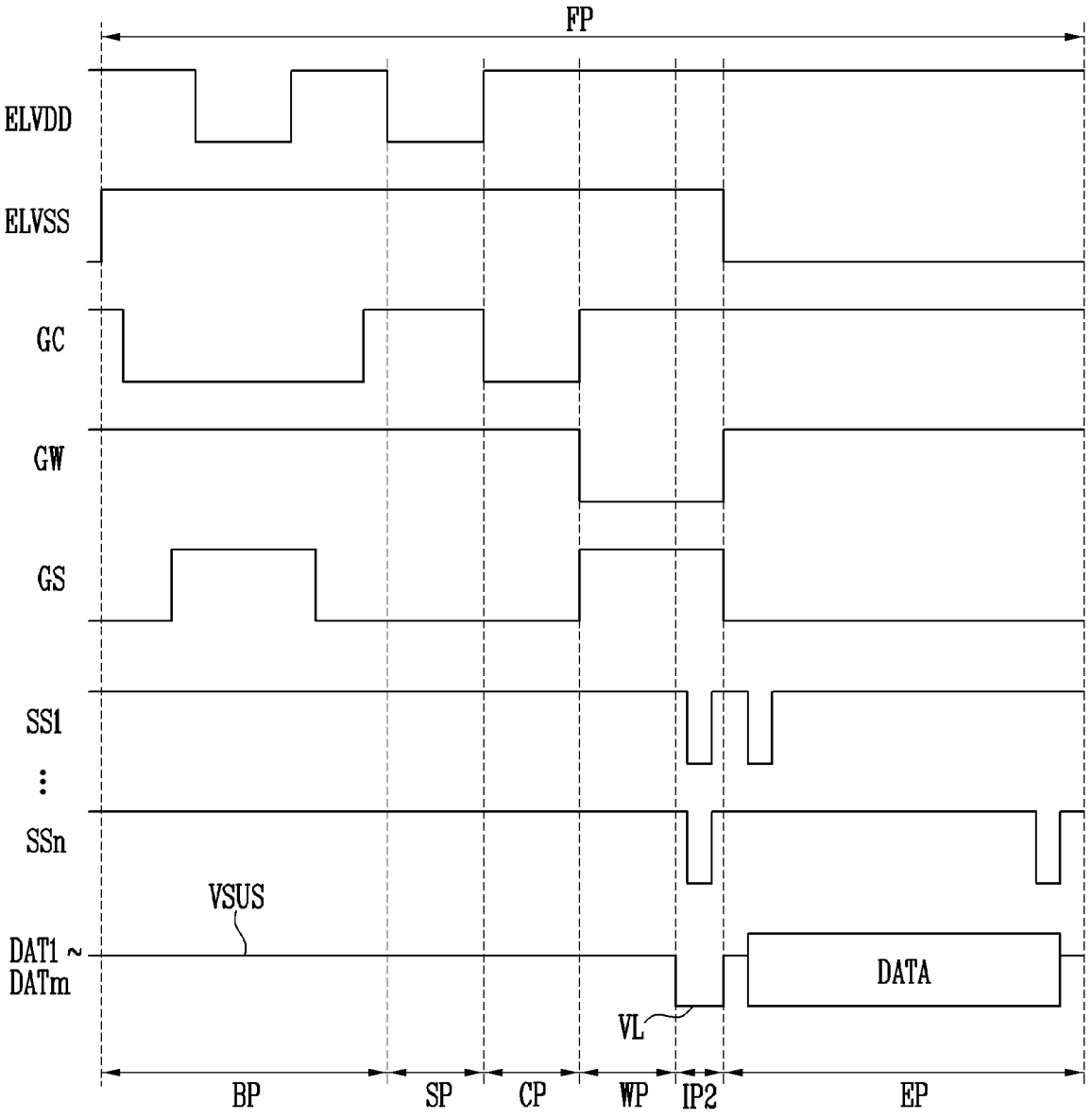
FIG. 8 is a timing diagram illustrating an embodiment of a driving method of the display device including the pixel shown in FIG. 7.

FIG. 8 is a timing diagram illustrating an embodiment of a driving method of the display device 100' including the pixel PXL' shown in FIG. 7.

The driving method of the display device 100', which is shown in FIG. 8, corresponds to the driving method of the display device 100, which is shown in FIG. 4. Therefore, differences between the driving method of the display device 100', which is shown in FIG. 8, and the driving method of the display device 100, which is shown in FIG. 4, will be mainly described below to avoid redundancy.

Referring to FIGS. 3, 4, 6, 7, and 8, the display device 100' may display an image during a frame period FP. That is, the pixels PXL' included in the display device 100' may be driven in units of frames.

Voltages of a first power source ELVDD, a second power source ELVSS, a reset signal GS, a compensation signal GC, a relay signal GW, first to nth scan signals SS1 to SSn, and data signals DAT1 to DATm during the frame period FP are illustrated in FIG. 8.

Hereinafter, it is described that the reset signal GS, the compensation signal GC, and the relay signal GW have a gate-on voltage.

In FIGS. 7 and 8, an embodiment in which the first transistor T1, the second transistor T2, the third transistor T3, the fourth transistor T4, and the fifth transistor T5 are implemented with P-channel MOS transistors is representatively described. Therefore, the gate-on voltage is illustrated as a high-level voltage, and a gate-off voltage is illustrated as a low-level voltage.

According to the embodiment of the driving method of the display device 100', which is shown in FIG. 8, the frame period FP may include an off period BP, a reset period SP, a compensation period CP, a relay period WP, an emission initialization period IP2, and an emission period EP.

The off period BP, the reset period SP, the compensation period CP, the relay period WP, the emission initialization period IP2, and the emission period EP may occur sequentially.

The data signals DAT1 to DATm may have a first reference voltage VSUS during the emission initialization period IP2 and the other periods except the emission period EP in the frame period FP. Here, the first reference voltage VSUS may be set as a specific voltage in a voltage range of a data signal to be supplied from the data driver 130'.

The second power source ELVSS may have a high-level voltage during the other periods except the emission period EP in the frame period FP. During the emission period EP, the pixels PXL' are set to a non-emission state.

The contents of the off period BP, the reset period SP, the compensation period CP, the relay period WP, and the emission period EP, which are described in FIG. 3, may be applied to the off period BP, the reset period SP, the compensation period CP, the relay period WP, and the emission period EP, which are shown in FIG. 8.

In some embodiments, the emission initialization period IP2 shown in FIG. 8 may be implemented differently from the emission initialization period IP2 shown in FIGS. 4 and 5. This will be described in detail below.

The emission initialization period IP2 is a period for removing a threshold voltage component of the first transistor T1, i.e., noise that remains in the anode electrode of the organic light emitting diode OLED before the emission period EP.

The relay signal GW may be supplied during the emission initialization period IP2. When the relay signal GW is supplied, the fourth transistor T4 is turned on, and therefore, a fourth node N4 and a third node N3 may be electrically coupled to each other.

In addition, during the emission initialization period IP2, the first to nth scan signals SS1 to SSn may be supplied in a lump (e.g., at substantially the same time). When a scan signal is supplied, the fifth transistor T5 is turned on, and therefore, the jth data line Dj and the fourth node N4 may be electrically coupled to each other.

Furthermore, during the emission initialization period IP2, the data signals DAT1 to DATm may have a second reference voltage VL different from the first reference voltage VSUS. Here, the second reference voltage VL may be set as a minimum voltage in a voltage range of a data signal to be supplied from the data driver 130'. That is, the second reference voltage VL may be lower than the first reference voltage VSUS.

Therefore, the second reference voltage VL may be applied to the third node N3 via the fourth transistor T4 and the fifth transistor T5.

When the second reference voltage VL is applied to the third node N3, the voltage of a first node N1 may be decreased due to coupling caused by the first capacitor C1. At this time, the first transistor T1 is turned on, and the anode electrode of the organic light emitting diode OLED and the first power source ELVDD may be electrically coupled to each other.

During the emission initialization period IP2, the first power source ELVDD may have a high-level voltage. Therefore, the anode electrode of the organic light emitting diode OLED may be initialized to the high-level voltage of the first power source ELVDD, and the threshold voltage component of the first transistor T1 may be removed from the anode electrode of the organic light emitting diode OLED.

Meanwhile, during the emission initialization period IP2, the second power source ELVSS may have the high-level voltage, and the compensation signal GC and the reset signal GS may not be supplied.

According to the present disclosure, the display device can improve image quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims and their equivalents.

What is claimed is:

1. A display device comprising:

pixels driven in units of frame periods, wherein each frame period comprises a reset period, a compensation period, a relay period, an emission period, and an initialization period, and wherein the initialization period is located between the reset period and the compensation period or between the relay period and the emission period;

wherein each of the pixels comprises:

an organic light emitting diode having an anode electrode coupled to a second node and a cathode electrode coupled to a second power source;

a first transistor coupled between a first power source and the second node, the first transistor having a gate electrode coupled to a first node;

a second transistor coupled between the first node and the second node, the second transistor being configured to turn on when a compensation signal is supplied during the compensation period;

a third transistor coupled between the first power source and a third node, the third transistor being configured to be in a turned on state according to a reset signal supplied during the reset period;

a fourth transistor coupled between a fourth node and the third node, the fourth transistor being configured to turn on when a relay signal is supplied during the relay period;

a fifth transistor coupled between a data line and the fourth node, the fifth transistor being turned on when a scan signal is supplied during the emission period;

a sixth transistor coupled between a third power source and the second node, the sixth transistor being configured to turn on when an initialization signal is supplied during the initialization period;

a first capacitor coupled between the third node and the first node; and a second capacitor coupled between the fourth node and the third power source.

2. The display device of claim 1, wherein, during the initialization period, the compensation signal is not supplied, and the sixth transistor is configured to turn on as the initialization signal is supplied, initializing the anode electrode of the organic light emitting diode to a voltage of the third power source.

3. The display device of claim 2, wherein the initialization period is located between the reset period and the compensation period.

4. The display device of claim 2, wherein the initialization period is located between the relay period and the emission period.

5. The display device of claim 2, wherein the initialization period comprises a compensation initialization period located between the reset period and the compensation period and an emission initialization period between the relay period and the emission period.

6. The display device of claim 1, wherein, during the reset period:

the first power source has a low-level voltage; and the third transistor is configured to be in the turned on state according to the reset signal, resetting the anode electrode of the organic light emitting diode to the low-level voltage of the first power source.

7. The display device of claim 1, wherein, during the compensation period:

the second transistor is configured to be in a turned on state according to the compensation signal, diode-coupling the first transistor; and the third transistor is configured to be in the turned on state according to the reset signal, storing a threshold voltage of the first transistor in the first capacitor.

8. The display device of claim 1, wherein, during the relay period, the fourth transistor is configured to turn on as the relay signal is supplied, transferring a voltage stored in the second capacitor to the first capacitor.

9. The display device of claim 1, wherein, during the emission period:

the third transistor is configured to be in the turned on state according to the reset signal, the such that a voltage of the first power source is applied to the third node, and wherein the first power source has a high-level voltage;

the second power source has a low-level voltage; and the organic light emitting diode generates light.

10. The display device of claim 1, wherein, during the emission period:

the fifth transistor is configured to be in the turned on state according to the scan signal, electrically coupling the data line and the fourth node to each other; and a data signal of a current frame is applied to the fourth node in synchronization with the scan signal.

11. The display device of claim 1, wherein each frame period further comprises an off period for applying an off bias to the first transistor, wherein the off period is prior to the reset period.

12. The display device of claim 11, wherein, during the off period, the first power source has a low-level voltage, and the compensation signal is supplied.

13. The display device of claim 1, further comprising:

a display unit comprising the pixels;

a driving signal supply configured to supply the reset signal, the compensation signal, the relay signal, and the initialization signal to the display unit; and a power supply configured to determine a voltage of each of the first power source, the second power source, and the third power source, and supply the determined voltages to the display unit.

14. The display device of claim 13, further comprising:

a scan driver configured to sequentially supply scan signals to scan lines; and a data driver configured to supply data signals to data lines.

15. The display device of claim 1, wherein the first to sixth transistors are P-channel MOS transistors.

16. A display device comprising:

pixels driven in units of frame periods, wherein each frame period comprises a reset period, a compensation period, a relay period, an emission period, and an initialization period, and wherein the initialization period is located between the relay period and the emission period;

wherein each of the pixels comprises:

an organic light emitting diode having an anode electrode coupled to a second node and a cathode electrode coupled to a second power source;

a first transistor coupled between a first power source and the second node, the first transistor having a gate electrode coupled to a first node;

a second transistor coupled between the first node and the second node, the second transistor being configured to turn on when a compensation signal is supplied during the compensation period;

a third transistor coupled between the first power source and a third node, the third transistor being configured to be in a turned on state according to a reset signal supplied during the reset period;

a fourth transistor coupled between a fourth node and the third node, the fourth transistor being configured to turn on when a relay signal is supplied during the relay period and the initialization period, and the second transistor being configured to be turned off when the relay signal is supplied during the relay period;

a fifth transistor coupled between a data line and the fourth node, the fifth transistor being configured to turn on when a scan signal is supplied during the initialization period and the emission period;

a first capacitor coupled between the third node and the first node; and a second capacitor coupled between the fourth node and a third power source.

17. The display device of claim 16, wherein, during the initialization period, the relay signal is supplied, and scan signals are supplied in a lump.

18. The display device of claim 17, wherein data signals have a first reference voltage during the reset period, the compensation period, and the relay period, and wherein the data signals have a second reference voltage different from the first reference voltage during the initialization period.

19. The display device of claim 18, wherein the second reference voltage is lower than the first reference voltage.

20. A display device comprising:

pixels driven in units of frame periods, wherein each frame period comprises a reset period, a compensation period, a relay period, an emission period, and an initialization period, wherein each of the pixels comprises:

an organic light emitting diode having an anode electrode coupled to a second node and a cathode electrode coupled to a second power source;

a first transistor coupled between a first power source and the second node, the first transistor having a gate electrode coupled to a first node;

a second transistor coupled between the first node and the second node, the second transistor being configured to turn on when a compensation signal is supplied during the compensation period;

a third transistor coupled between the first power source and a third node, the third transistor being configured to be in a turned on state according to a reset signal supplied during the reset period;

a fourth transistor coupled between a fourth node and the third node, the fourth transistor being configured to turn on when a relay signal is supplied during the relay period;

a fifth transistor coupled between a data line and the fourth node, the fifth transistor being turned on when a scan signal is supplied during the emission period;

a sixth transistor coupled between a third power source and the second node, the sixth transistor being configured to turn on when an initialization signal is supplied during the initialization period;

a first capacitor coupled between the third node and the first node; and a second capacitor coupled between the fourth node and the third power source.

* * * * *